US006087573A

United States Patent [19]

Falliex

[11] Patent Number: 6,087,573

[45] Date of Patent: Jul. 11, 2000

[54] HEEL-OPERATED DEVICE FOR A FOOT PEDAL-ACTUATED INSTRUMENT OF A DRUM SET

[76] Inventor: Philippe Falliex, 142 rue Gambetta, F-92150 Suresnes, France

[21] Appl. No.: 09/043,576

[22] PCT Filed: Sep. 24, 1996

[86] PCT No.: PCT/FR96/01484

§ 371 Date: Aug. 25, 1998

§ 102(e) Date: Aug. 25, 1998

[87] PCT Pub. No.: WO97/12358

PCT Pub. Date: Apr. 3, 1997

[30] Foreign Application Priority Data

Sep. 26, 1995 [FR] France ..... 95/11272

[51] Int. Cl.[7] ..... G10D 13/02

[52] U.S. Cl. ..... 84/422.1; 84/422.2; 84/42.3

[58] Field of Search ..... 84/422.1, 422.2, 84/422.3

[56] References Cited

U.S. PATENT DOCUMENTS 3,747,464 7/1973 Russell ..... 84/422

4,262,576 4/1981 Gorsy et al. ..... 84/422

5,557,054 9/1996 Shigenaga ..... 84/422.1

5,565,638 10/1996 Liao ..... 84/422.1

*Primary Examiner*—Robert E. Nappi

*Assistant Examiner*—Kim Lockett

*Attorney, Agent, or Firm*—Blank Rome Comisky & McCauley LLP

[57] ABSTRACT

A heel-operated device of a foot pedal-actuated instrument of a drum set enables a user to play two instruments of the drum set using the same foot to actuate separate foot pedals. One foot pedal controls the play of one instrument and another foot pedal controls the play of the second instrument of the drum set. At least one of the two instruments is a drum, and the other may be cymbals or bell or another drum. The heel-operated device includes a heel-actuated member, a rod hinged at one end of the heel-actuated member and pivotally coupled to one foot pedal for depression thereof by pressure of the heel of a foot of the user on the heel-actuated member to play the first instrument while allowing the tip of the same foot of the user freedom to operate the other foot pedal for actuating the second instrument. The base member is hinged to an end of the heel-actuated member opposite the end thereof at which the rod is hinged, to provide stability of the heel-operated device during play of the drum set.

5 Claims, 2 Drawing Sheets

HEEL-OPERATED DEVICE FOR A FOOT PEDAL-ACTUATED INSTRUMENT OF A DRUM SET

BACKGROUND OF THE INVENTION

The present invention concerns a heel-operated device which allows for the actuation of a part of a musical drum set with the user's (player's or drummer's) heel, and more specifically, a device that allows operation of a pedal for actuating play of an instrument of a musical drum set with the user's heel while allowing the ball or tip of the same foot freedom to operate a second pedal for actuating play of a second instrument such as a pair of cymbals.

Usually in the area of musical drum sets, the player's right foot actuates the foot pedal of a part of a musical drum set—for example, a large drum 13 and the left foot actuates the foot pedal of another part of the drum set—for example, a Charleston pedal that controls the clashing of a pair of cymbals together. This is the case for a right-handed user, with the inverse for a left-handed person. In the case, for example, in which the drum set consists of a large drum and Charleston cymbals and has been designed for a right-handed person, a pedal is positioned for the right foot and, when operated, this foot pedal actuates a striking hammer that strikes the skin of the large drum. A second pedal is positioned for the left foot and, when operated, this second foot pedal actuates a striking hammer that strikes the skin of the large drum. A third foot pedal—the Charleston pedal—is typically placed next to the second pedal of the large drum and, like the second pedal is also intended to be actuated by the left foot.

The known ways of carrying out the operation and play of such a drum set present a considerable inconvenience as a consequence of the existence of two pedals intended to be actuated by the same foot—e.g., the second pedal of the large drum and the Charleston pedal—which requires that the user must choose to actuate either one foot pedal or the other. These known ways do not permit the user to actuate the two pedals simultaneously.

U.S. Pat. No. 3,747,464 discloses the use of two pedals with the same foot—i.e., by activating the pedal of a large drum with the heel—but the arrangement has the inconvenience of being very difficult to use in a practical manner in so far as it does not have any element that allows the user to actuate the two pedals simultaneously in a meaningful way and does not allow the striking force to be controlled in a meaningful way.

The goal of the present invention therefore consists in avoiding the inconveniences of using conventional foot pedal operated drum sets in which two pedals are provided for operation by the same foot of the player.

SUMMARY OF THE INVENTION

Briefly, according to the present invention, a heel-operated device is provided which allows the player to actuate a pedal of a part of a musical drum set with the heel with an improvement that allows the pedal to be actuated by the heel, by the tip of the foot, or by the entire foot. In an exemplary preferred embodiment, the heel-operated device is attached to one of the pedals of a drum instrument—for example, to the second pedal of a large drum. When applied to this second pedal which is placed next to a Charleston pedal the principle of the invention allows the user to operate the second pedal of the large drum and the Charleston pedal simultaneously or alternately.

More precisely, the invention allows the user to actuate the second pedal of a large drum either simply with the tip of the foot or with the heel, with the tip of the foot allowed to be kept on the Charleston pedal. In this way, the user can play the two pedals simultaneously, which allows time to be conserved because there is no longer a need to move the foot from one pedal to the other. Consequently, the user is allowed to play new musical phrases that would not be possible without the device. The device can be attached to a pedal, but it can also be integrated into a pedal during its manufacture, for example, through molding.

BRIEF DESCRIPTION OF THE DRAWINGS

The above and further goals, aims, objectives and aspects of the invention will be more fully understood from the following description of a presently preferred embodiment constituting the best mode presently contemplated of practicing the invention, when considered with the accompanying drawings illustrating the principles of the invention diagrammatically and by way of example, and in which.

DETAILED DESCRIPTION OF THE PRESENTLY PREFERRED EMBODIMENT

Figure 1:
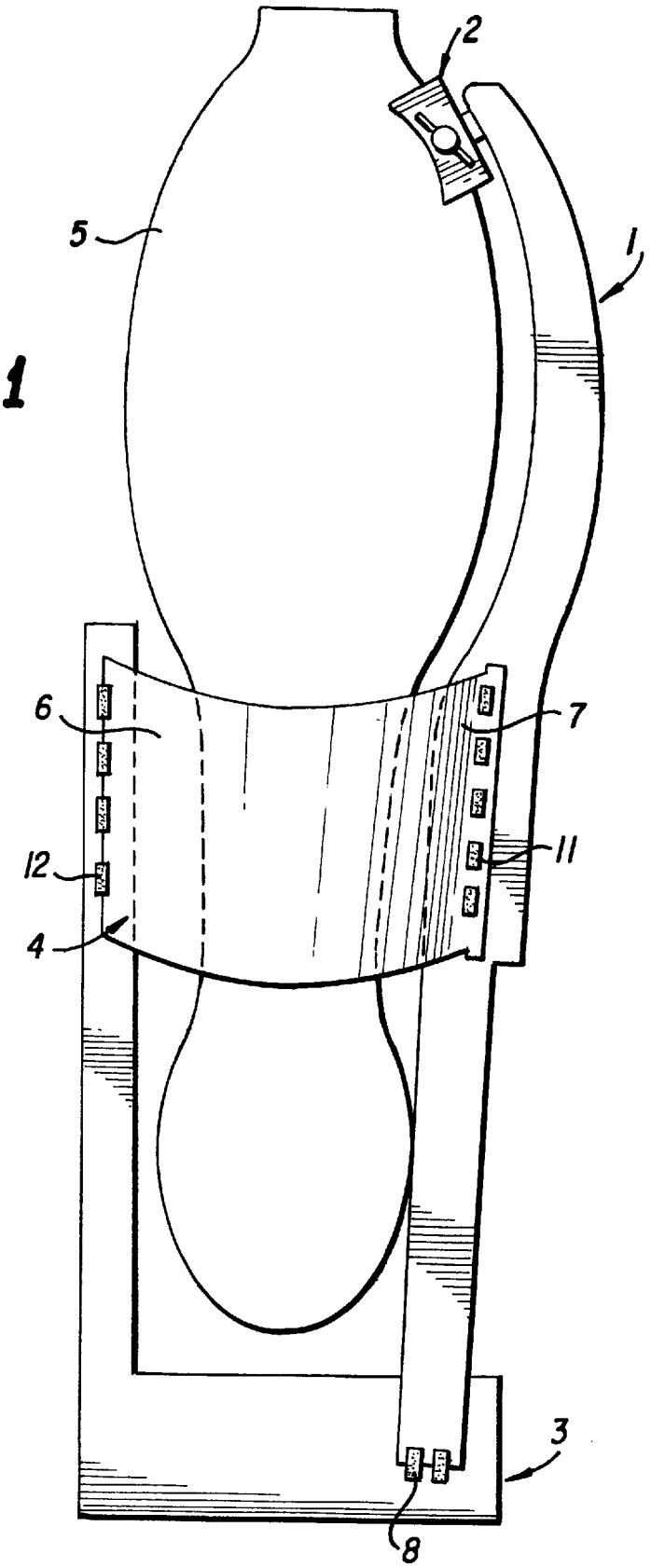
FIG. 1 is a top view of a pedal with the heel-operated device.
Figure 2:
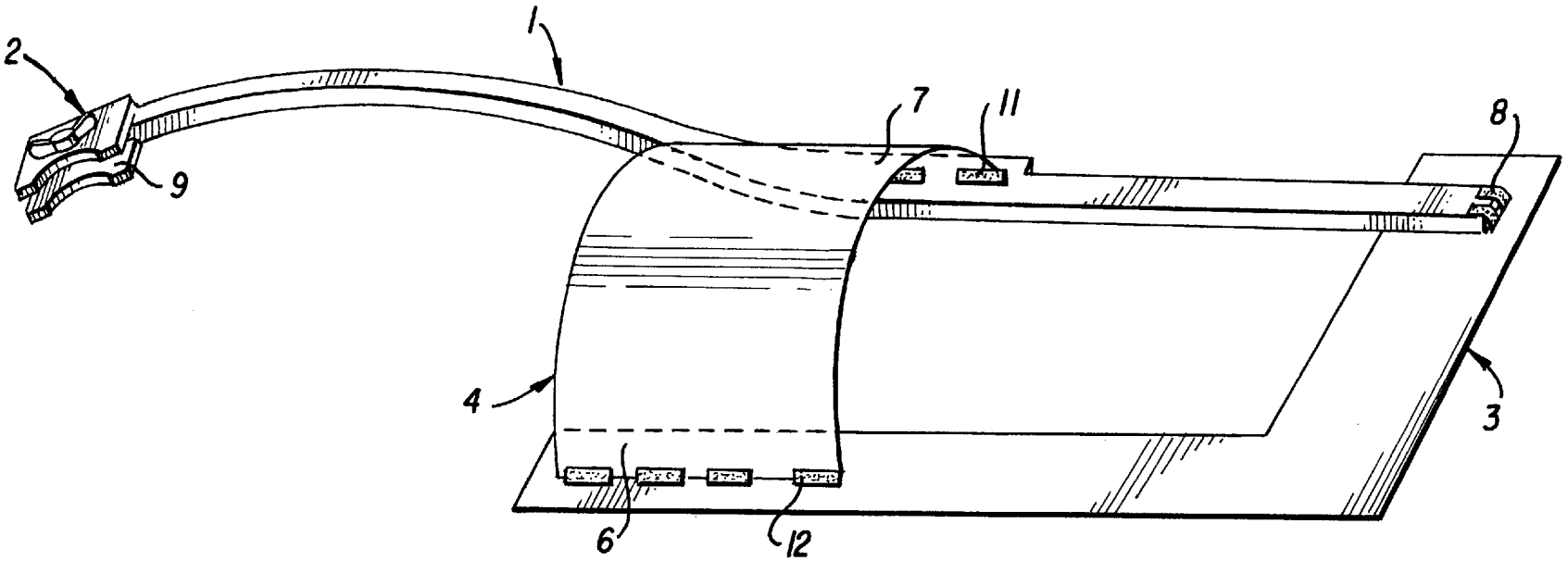
FIG. 2 is a simplified perspective view of the side of the heel-operated device.

In reference to FIGS. 1 and 2, the device consists of four metal parts that are linked together, namely, a base 3, a rod 1, which is intended to link the base 3 to a pedal 5 by means of a pivoting jaw 2, and an arcuate member 4 that is attached at one end 6 to the base and at the other end 7 to the rod 1. The rod 1 and the base 3 are linked together by a hinge 8, which allows the rod to be mobile and move with the pedal 5, to which it is firmly attached by jaw 2. A gap 9 is left in or between the jaw, which is attached to the skin of the pedal 5 and the rod 1 in a way so that the two elements are prevented from getting caught in each other. The arcuate member 4 is attached by hinges 11 and 12 to the rod 1 and the base 3. In so doing, the arcuate member is mobile and can move with the rod.

In practice, the user can exert pressure on the arcuate member 4 with the heel of the user's foot which will cause the pedal to be lowered by means of the rod. The pedal is returned to the raised position by a spring (not shown), which is already conventionally mounted on the foot pedal associated with the large drum of each musical instrument. While pushing the arcuate member with the heel, the user can actuate another pedal—for example, a Charleston pedal (not shown)—with the tip of the foot. In the case in which the Charleston pedal is not used, the player can actuate the pedal equipped with the device either by putting the heel or foot on the arcuate member or the tip of the foot on the pedal.

The device can be adapted to all the pedals of instruments in a musical drum set—for example, a pedal of a large drum, a Charleston pedal, or a pedal to actuate the bells.

Thus, it will be observed that the present invention is a heel-operated device of a foot pedal-actuated instrument of a drum set that enables a user of the drum set to play two instruments of the drum set using the same foot by actuating separate foot pedals. One foot pedal of the separate food pedals is coupled for play of the instrument and another foot pedal of the separate food pedals is coupled for play of another instrument of the drum set, at least one of the instruments being a drum. The heel-operated device comprises a heel-actuated member, a rod hinged at one end of the heel-actuated member and pivotally coupled to the one foot pedal for depression thereof by pressure of the heel of a foot of the user on the heel-actuated member to play the first-mentioned instrument while allowing the tip of the same foot of the user freedom to operate the other foot pedal for actuating the other instrument of the drum set. The base member is hinged to an end of the heel-actuated member opposite the end thereof at which the rod is hinged, to provide stability of the heel-operated device during play of the drum set.

Although a presently preferred embodiment has been described herein, various modifications of the invention will become apparent to persons of ordinary skill in the field from a consideration of the foregoing detailed description, without departing from the spirit and scope of the invention. It is therefore intended that the present invention shall be limited only by the appended claims and by the rules and principles of applicable law.

I claim:

1. A heel-operated device for a foot pedal-actuated instrument of a drum set, comprising a heel-actuated member for pivotal linkage in non-binding fashion to a first foot pedal of said foot pedal-actuated instrument to allow the tip of a player's foot to operate a second foot pedal for actuating a second instrument of said drum set while the heel of the player's same foot is positioned to actuate said first foot pedal via said pivotal linkage thereto, and a base member hinged to said heel-actuated member for stability thereof.

2. The heel-operated device of claim 1, wherein said heel-actuated member comprises a heel-rest member, a rod member, and a pivoting clamp for said pivotal-linkage of said rod member to said first foot pedals, said rod member being separately hinged to said base member and to one end of said heel-rest member.

3. The heel-operated device of claim 2, wherein said heel-rest member comprises a rigid arcuately-shaped member spaced apart from and overlying said first foot pedal when said rod member is hinged to said heel-actuated member.

4. The heel-operated device of claim 3 wherein said heel-rest member is further hinged at an end thereof opposite said one end to said base member as said hinging of said base member to said heel-actuated member.

5. A heel-operated device of a foot pedal-actuated instrument of a drum set to enable a user to play two instruments of said drum set using the same foot by actuating separate foot pedals, one foot pedal of said separate food pedals coupled for play of the first-mentioned instrument and another foot pedal of said separate food pedals coupled for play of another instrument of said drum set, at least one of said instruments being a drum, said heel-operated device comprising a heel-actuated member, a rod hinged at one end of said heel-actuated member and pivotally coupled to said one foot pedal for depression thereof by pressure of the heel of said foot of the user on said heel-actuated member to play said first-mentioned instrument while allowing the tip of said foot of the user freedom to operate said another foot pedal for actuating said another instrument of said drum set, and a base member hinged to an end of said heel-actuated member opposite said one end thereof for stability of the heel-operated device during play of said drum set.

* * * * *